US012264440B2

(12) United States Patent
Rothaug et al.

(10) Patent No.: US 12,264,440 B2
(45) Date of Patent: Apr. 1, 2025

(54) PROCESS AND APPARATUS FOR PRODUCING A MOLDED FIBER ARTICLE

(71) Applicant: KURTZ GMBH & CO. KG, Kreuzwertheim (DE)

(72) Inventors: Uwe Rothaug, Marktheidenfeld (DE); Constantin Kemmer, Marktheidenfeld (DE)

(73) Assignee: KURTZ GMBH & CO. KG, Kreuzwertheim (DE)

( * ) Notice: Subject to any disclaimer, the term of this patent is extended or adjusted under 35 U.S.C. 154(b) by 0 days.

(21) Appl. No.: 18/546,297

(22) PCT Filed: Feb. 10, 2022

(86) PCT No.: PCT/EP2022/053226
§ 371 (c)(1),
(2) Date: Aug. 14, 2023

(87) PCT Pub. No.: WO2022/171733
PCT Pub. Date: Aug. 18, 2022

(65) Prior Publication Data

US 2024/0117569 A1 Apr. 11, 2024

(30) Foreign Application Priority Data

Feb. 15, 2021 (DE) ..... 10 2021 103 524.4

(51) Int. Cl.
*D21J 1/06* (2006.01)
*D21D 99/00* (2006.01)
*D21J 1/14* (2006.01)

(52) U.S. Cl.
CPC . *D21J 1/06* (2013.01); *D21J 1/14* (2013.01); *D21D 99/00* (2013.01)

(58) Field of Classification Search
CPC ..... D21J 1/06; D21J 1/14; D21J 3/00; D21D 99/00
See application file for complete search history.

(56) References Cited

U.S. PATENT DOCUMENTS 6,706,151 B1 3/2004 Oosthuizen et al.
11,365,518 B2 6/2022 Hardacre et al.
2019/0169800 A1* 6/2019 Hardacre ..... D21F 5/167

FOREIGN PATENT DOCUMENTS

CN 205000197 U * 1/2016
CN 106245463 A 12/2016
(Continued)

OTHER PUBLICATIONS

International Preliminary Report on Patentability, mailed on Aug. 1, 2023, from International Application No. PCT/EP2022/053226, filed on Feb. 10, 2022. 11 pages. English translation.
(Continued)

*Primary Examiner* — Jacob T Minskey
*Assistant Examiner* — Matthew M Eslami
(74) *Attorney, Agent, or Firm* — HoustonHogle LLP

(57) ABSTRACT

The invention relates to a process and an apparatus for producing a molded fiber article. The process comprises the steps of —dissolving fibrous materials in water to form a fibrous material suspension in a pulper, —removing moisture from the fibrous material suspension by pressing to form a molded fiber article in a mold and/or —drying the molded fiber article by supplying heat, —demolding the molded fiber article from the mold. The process is characterized by the feature whereby, in mold drying of the molded fiber article in the mold, a moisture content of the molded fiber article of not more than 10% by weight or not more than 7.5% by weight or not more than 5% by weight is achieved.

13 Claims, 1 Drawing Sheet

(56) References Cited

FOREIGN PATENT DOCUMENTS

| | | | |
|---|---|---|---|
| CN | 109072567 | A | 12/2018 |
| CN | 109477310 | A | 3/2019 |
| DE | 102019116134 | A1 | 12/2020 |
| GB | 2413301 | A | 10/2005 |
| JP | 2000000806 | A | 1/2000 |
| JP | 2002088699 | A | 3/2002 |

OTHER PUBLICATIONS

Article 34 claim amendments from International Application No. PCT/EP2022/053226, filed on Feb. 10, 2022. 6 pages.
International Search Report and Written Opinion of the International Searching Authority, mailed on May 13, 2022, from International Application No. PCT/EP2022/053226, filed on Feb. 10, 2022. 18 pages.
International Preliminary Examination Report, mailed on Jan. 27, 2023, from International Application No. PCT/EP2022/053226, filed on Feb. 10, 2022. 8 pages.
International Preliminary Report on Patentability, mailed on Jun. 6, 2023, from International Application No. PCT/EP2022/053226, filed on Feb. 10, 2022, which includes claims amended under Article 34. 16 pages.
International Preliminary Report on Patentability, mailed on Aug. 1, 2023, from International Application No. PCT/EP2022/053226, filed on Feb. 10, 2022. 6 pages.
Germany (DE) Office Action, mailed on Jun. 2, 2023, from German Application No. 10 2021 103 524.4. 4 pages.
Chinese (CN) Office Action issued on Mar. 12, 2024 from Chinese Application No. 202280015118.4. 11 pages.

* cited by examiner

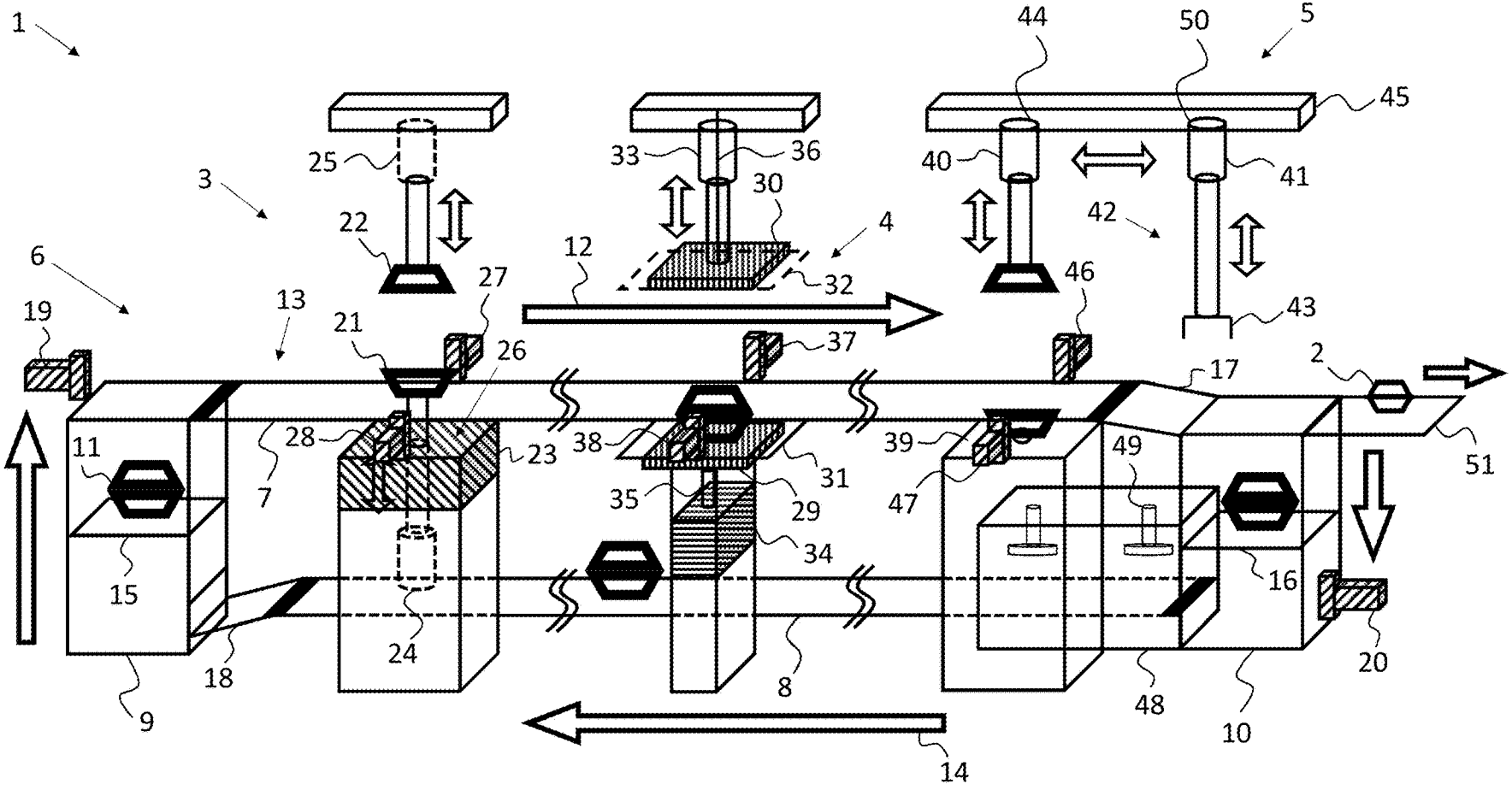
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51

PROCESS AND APPARATUS FOR PRODUCING A MOLDED FIBER ARTICLE

RELATED APPLICATIONS

This application is a § 371 National Phase Application of International Application No. PCT/EP2022/053226, filed on Feb. 10, 2022, now International Publication No. WO/2022/171733, published on Aug. 18, 2022, which International Application claims priority to German Application 10 2021 103 524.4, filed on Feb. 15, 2021, both of which are incorporated herein by reference in their entirety.

The present invention relates to a process and an apparatus for producing a molded fiber article.

Molded fiber articles, which are also referred to as molded pulp, are produced by dissolving fibers in a pulper to form a fibrous material suspension, and then produced by molding the fibrous material suspension in a mold. Heat is applied to dry the molded fiber article so that the fibers bond together to form a solid object.

The fibers used are mainly cellulose fibers from waste-paper or fresh fibers. However, other fibers, in particular natural fibers, which are recyclable and/or compostable, can also be used. Such fibers are made of hemp, for example.

Molded fiber articles have become more important in the packaging industry in recent years. On the one hand, this is because molded fiber articles are usually biodegradable and therefore easy and inexpensive to dispose of. Furthermore, molded fiber articles can be recycled cheaply by re-shredding a molded fiber article into individual fibers and forming them into a new molded fiber article. Molded fiber articles are also space-saving, stable and shock-absorbent. Molded fiber articles can be produced in any three-dimensional shape, allowing them to be adapted to a wide variety of products. Molded fiber articles can be flame retardant and/or grease and water repellent.

In a conventional process for producing a molded fiber article, the fibers are dissolved with water in a pulper to form a fibrous material suspension. The fibrous material suspension forms a pulp that is molded into a molded fiber article in a mold. The mold has at least one mold half, which limits the mold interior space by means of a grid. This mold is referred to as a grid tool. The grid tool has a large number of openings through which water can escape from the mold interior space. The process step of molding the fibrous material suspension thus serves not only for forming, but also for drying. A molded fiber article, demolded from the mold, is dried and cured in a hot air stream.

It is also known that molded fiber articles are dried during and/or after molding by means of electromagnetic waves. RF or microwave radiation is frequently used for this purpose.

A molded fiber article produced in this way can then be fed to an embossing and/or punching tool by further forming the molded fiber article.

Molded fiber articles are mass-produced articles that are manufactured in large quantities in the packaging industry for packaging items. There is therefore a significant demand to improve the process in such a way that throughput is increased and/or costs are reduced.

GB 2 413 301 A relates to a process and an apparatus for producing a molded part made of pulp, in which radio waves are used to form and dry the part. The starting material is a fibrous material suspension, which is subsequently pressed and dried. Furthermore, the device of D1 consists of two metal mold halves, which can serve as electrodes for generating an RF field and are connected to an external RF generator. The fibrous material suspension is located between the two mold halves, which are designed in such a way that water or water vapor can leave the can leave the molds. A dielectric layer is located in the limit range between the fibrous material suspension and the mold halves, which serves as an electrical insulator and protects the fibrous material suspension from direct current flow.

From the US 2019/0169800 A1, a process and an apparatus for the production of a molded part formed from cellulose, in particular for the production of a bottle of cellulose. A starting material is a suspension of fibrous material. Her A porous mold consisting of at least two separable parts serves as the mold, which may be made of metal. The molded part is dried in a microwave drying chamber.

The invention is based on the task to provide a process or an apparatus for producing a molded fiber article, with which molded fiber articles can be produced with a high throughput and at low costs.

Furthermore, the invention is based on the task to provide a process for producing a molded fiber article that is reliable, safe and stable.

The task is solved by the objects of the independent patent claims. Advantageous embodiments of the invention are specified in the respective subsidiary claims. A process for producing a molded fiber article according to a first aspect of the present invention comprises the following steps:

- Dissolving of fibrous materials in water to form a fibrous material suspension in a pulper,
- Dehumidifying of the fibrous material suspension by pressing to form a molded fiber article in a mold and/or
- Drying the molded fiber article by supplying heat to the mold and
- Demolding the molded fiber article from the mold.

The process is characterized in that, during a mold drying of the molded fiber article, the molded fiber article is subjected to electromagnetic waves in such a way that it dries in the mold until a moisture content of the molded fiber article of not more than 10% by weight or not more than 7.5% by weight or not more than 5% by weight is achieved.

In the present invention, in contrast to the process known from US 2019/0169800 A1, the molded fiber article is dried in the mold to a moisture content of the molded fiber article of not more than 10% by weight. In US 2019/0169800 A1, the molded fiber article is also dried to a low moisture content, but here, the molded fiber article is removed from the mold before drying.

Drying to such a low moisture content of not more than 10% by weight in the mold results in the molded fiber article taking exactly the form of the mold. For example, if the mold has a smooth surface, then the molded fiber article will have a correspondingly smooth surface. Such smooth molded fiber articles are perceived as high-quality products.

By using electromagnetic waves, it is possible to quickly heat the molded fiber article from the inside out in a short time, thereby achieving the desired degree of dryness accordingly quickly. Basically, it would also be possible to heat the mold and thus, indirectly mold-dry the molded fiber article. However, this is significantly less efficient than heating the molded fiber article directly using electromagnetic waves.

In principle, microwaves and RF radiation can be used as electromagnetic waves. RF radiation has the advantage that due to the long wavelength of RF radiation; the entire molded fiber article can be heated uniformly at once. With microwaves, the heat input is localized, so that the microwave radiation beam must be moved relative to the molded fiber article during drying. This means a delay in the drying process and can also lead to uneven heating and therefore uneven drying.

The achievement of a moisture content of the molded fiber article of not more than 5% by weight through an active drying process allows for fast further processing of the molded fiber article after drying. On the one hand, this enables an increased throughput for the production of the molded fiber articles and, on the other hand, saves space for further drying steps and/or intermediate storage. Both ensure that the entire production of molded fiber articles can be carried out more efficiently. Pressing the fibrous material suspension to the molded fiber article in the mold takes place in the pulper, as this ensures that the mold is completely filled with fibrous material suspension during pressing. In this way, molded fiber articles can be produced that comprise a predetermined density and surface contour.

When drying by means of electromagnetic waves, drying times of less than one minute per molded fiber article can be achieved. The combination of fast drying by means of electromagnetic waves and drying to such a low moisture content of not more than 5% by weight makes it possible to produce molded fiber articles that have both a smooth surface, as well as an increased surface quality and a precise final dimension. Compared to previously known molded fiber articles, these mold-dried molded fiber articles are of particularly high quality and thus offer new application possibilities, such as the packaging of high-quality end products.

The inventors of the present invention have recognized that a fast drying of a molded fiber article by means of electromagnetic waves and simultaneously effective drying in connection with a low moisture content of the molded fiber article is possible, thereby achieving a high quality of the molded fiber article.

Microwave radiation is particularly suitable for smaller molded fiber articles. Microwaves can be generated with very inexpensive microwave generators, called magnetrons.

Water absorbs electromagnetic waves very well. As a result, the fibrous material suspension can be heated directly. This allows the fibrous material suspension to be heated in the mold without the mold having to be heated first. The heat transfer into the molded fiber article is thus much more efficient than by means of indirect heating via hot air or the like. The curing of the fibrous material suspension in the mold can thus be significantly accelerated.

The demolded molded fiber article can also be heated directly by supplying heat by means of electromagnetic waves.

The more wet the molded fiber article is, the more it absorbs electromagnetic waves. As a result, the effect is stronger the more wet the molded fiber article is. A certain amount of self-regulation of the heating and drying is thus achieved.

Heating the fibrous suspension or the demolded molded fiber article by means of electromagnetic waves can thus accelerate the production process of a molded fiber article, while at the same time the required energy input is reduced.

Since molded fiber articles are generally produced in large quantities, even a slight acceleration of a single producing step represents a significant increase in the overall production throughput.

The production of molded fiber articles in large quantities also means that the energy saved in the production of a single molded fiber article add up over the large number of molded fiber articles and leads to a significant overall reduction in energy consumption input. This is of utmost importance for molded fiber articles, as molded fiber articles are accepted by the market due to their ecological advantages over other packaging materials, especially plastic packaging. The ecological balance of molded fiber articles also includes energy consumption in the production of molded fiber articles. A reduction in energy consumption means a higher acceptance of molded fiber articles on the market.

After the fibrous material suspension has been introduced into the mold, the molded fiber article can have a moisture content of not more than 80% by weight or not more than 70% by weight or not more than 60% by weight.

After the fibrous material suspension has been dehumidified in the mold, the molded fiber article can have a moisture content of not more than 30% by weight or not more than 25% by weight or not more than 20% by weight.

The molded fiber article can be dried in a drying station and demolded from the mold in a demolding station, with the pulper, the drying station and the demolding station forming workstations.

According to a second aspect of the present invention comprising the following steps:

- Dissolving of fibrous materials in water to form a fibrous material suspension in a pulper,
- Forming the fibrous material suspension into a molded fiber article by means of a mold in the pulper,
- Drying of the molded fiber article by supplying heat by means of electromagnetic waves in a drying station, and
- Demolding the molded fiber article from the mold.

The process is characterized in that, the mold is transported by means of a conveyor from the pulper to the drying station.

The inventors of the present invention have recognized that when producing a molded fiber article using electromagnetic waves to dry the molded fiber article, the molded fiber article should be allowed to drip for a predetermined time after being formed in the pulper, since an excessively high moisture content can cause problems when heating with electromagnetic waves.

By conveying the mold from the pulper to the drying station by means of a transport device, it is possible to decouple the forming step and the drying step of the molded fiber article in terms of time and location. In this way, a buffer is provided to give the molded fiber article sufficient time to drip.

This makes it possible to mold several molded fiber articles directly one after the other and/or to dry them directly one after the other, whereby several molds with the molded fiber articles contained therein can be held in one step for dripping until sufficient moisture has escaped from the molds. As soon as a predetermined degree of dryness has been reached, a mold with a molded fiber article can then be fed to the drying station.

Accordingly, a step of dripping the molded fiber article in the mold can be provided between the forming step and the drying step according to the invention. Preferably, this step can be carried out in a buffer area for simultaneously dripping of two or more molded fiber articles. Additionally, and/or alternatively, this step can also be carried out on a path from the pulper to the drying station on the transport device.

In this way, the process for producing a molded fiber article can be carried out efficiently and automatically.

By appropriate advantageous embodiments, which will be described in more detail below, several molds and/or several workstations, in particular pulpers and drying stations, can be used simultaneously in the production process, for example.

In this way, an apparatus used in the process can be efficiently utilized and, at the same time, it is possible that after pressing two mold halves together, there is sufficient time for the water to escape.

In addition, this process allows the drying of the molded fiber casting by pressing and heating by means of electromagnetic waves to be carried out in one mold.

In addition, the process may include a step of cooling the molded fiber article in the mold. In this way, there is sufficient time for cooling after heating.

The mold can be detachably attached to the pulper and after forming a molded fiber article, it can be automatically detached and transported to the next workstation.

In particular, it can be provided that one or more molds are attached to at least one of the workstations and/or to the transport device in a releasable manner, so that after processing at least one of the workstations, one or more molds are coupled into or out of a workstation and/or the transport device accordingly, preferably automatically.

The local separation of the pulper and the drying station makes it possible to allow the mold to drip and reduce the moisture in the mold and the molded fiber article. This prevents electrical flashovers during drying with electromagnetic waves, making the process more reliable, safer, and more stable.

The local separation of the work steps allows them to be carried out independently of each other. This makes it possible to decouple the processing steps of molding the molded fiber article in the pulper and drying it in the drying station.

In this way, any number of molds can be held between the molding step and the drying step. These molds, each containing a moist, freshly formed molded fiber article, can in themselves be left to drip for any length of time after forming before being dried in the drying station without affecting the throughput of the entire process. Since the dripping takes longer than the forming of the molded fiber article, more parts can thus be formed while others are ready before the drying station.

The mold is preferably detached from the pulper after each forming process and runs through the entire process path together with the respective molded fiber article. The mold can thus be designed as a separately manageable unit. This makes it easy to integrate a mold of a different type, which is designed for forming other molded fiber articles, into the process path and/or to produce different molds and thus different molded fiber articles with the process.

The mold halves can preferably be designed in such a way that, after forming in the pulper, they are connected to each other by means of an appropriate locking means by force, friction and/or positive locking.

Since the mold halves are hold together by a corresponding locking means, they form a stable unit that can be transported independently with the transport device.

When the wet fibrous material suspension is compressed during forming in the mold, the outlet holes of the mold are plugged, and joints are sealed. As a result, air con no longer enter the inside of the mold. As a result, the mold halves adhere to each other, and a large force is required to separate the mold halves. This connection alone is sufficient for transport on the transport device. In addition, this can be supported by the locking means. The transport device preferably conveys one or more molds along a circuit in a transport direction.

With these two embodiments, it is possible to run multiple molds in the circuit. This allows the molds to be temporarily stored, regardless of the frequency of the press and the RF station to allow water to drip and/or cool down after RF heating.

For example, 5 or 10 or 15 or 20 or 25 molds can be operated simultaneously in the circuit.

The drying station and/or a cooling station and/or a demolding station can be arranged in the transport direction along the transport device, and each receive at least one mold for processing in succession and/or simultaneously.

Especially at the cooling station, several molds can be picked up at the same time to cool down gradually. Buffers for holding several molds can be provided upstream of the individual workstations to achieve better time decoupling decoupling and maximum throughput on each workstation.

The individual workstations, in particular the drying station, the cooling station and the demolding station, can each have several devices operating parallel which can simultaneously receive at least one mold for processing.

In particular, the use of several drying stations operating parallel in the drying station enables a permanent utilization of all workstations and a constant throughput of finished molded fiber articles. In this case, molded fiber articles of different sizes can also be produced, in which the forming takes the same amount of time in each case, but the drying takes longer with increasing size.

By using several molds in the cycle, the work steps are further decoupled from one another in terms of time. Thus, with enough molds, it is possible for all workstations to be permanently utilized, even though the individual work steps require different amounts of time. The work steps of the individual molds can thus be carried out in parallel or in succession, depending on the number of workstations in question.

In particular, a mold can be arranged between at least two capacitor plates of the drying station, with the electromagnetic waves being applied to the mold via capacitor plates.

Furthermore, it is provided that a mold is arranged between at least two capacitor plates of the drying station, wherein the electromagnetic waves are applied to the mold via the capacitor plates.

The process according to the first aspect of the present invention can be combined in a particularly advantageous manner with the process according to the second aspect of the present invention. Such a process then exhibits the advantages shown above with reference to the two aspects.

According to a third aspect of the present invention, which can also be carried out independently of the process described above, a process for drying a molded fiber article in a drying station is provided, which is characterized in that electromagnetic waves are generated in the drying station by a wave generator and are introduced via a waveguide into a capacitor plate with a mold receiving area.

According to a first embodiment, it may be provided that the capacitor plate has a first dielectric layer in the mold receiving area, and a mold made of an electrically conductive material (metal) is arranged in the mold receiving area so that the capacitor plate forms a first capacitor with a first mold half of the mold, and wherein a second dielectric layer is provided in a contact area between the first mold half and a second mold half so that the first mold half and the second mold half form a second capacitor.

The second mold half is connected to ground. Preferably, the second mold half is in contact with a ground plate that is connected to ground.

The first capacitor, which the capacitor plate (first capacitor plate) forms with the first mold half of the mold (second capacitor plate), can be referred to as a coupling capacitor. The second capacitor, which is formed by the first mold half (second capacitor plate) and the second mold half (third capacitor plate), is hereinafter referred to as the mold capacitor.

By using the capacitor plate and the ground plate, a uniform electrical field is generated between the first mold half and the second mold half. This is a prerequisite for uniform heating of the molded fiber article in the mold. According to the first embodiment, the mold or at least one mold half is made of an electrically conductive material, preferably a metal.

In principle, it is also possible to connect the waveguide directly to the first mold half of the mold, as well as to connect a ground cable directly to the second mold half of the mold, however, a detachable connection of a waveguide is technically difficult to implement.

The capacitive coupling of the waveguide by means of the coupling capacitor to the electrically conductive mold half is easy to realize and leads to accurately repeatable transmission conditions. The upper mold halves form a capacitor plate of the coupling capacitor, and the dielectric is arranged between them. This makes it easy to replace the mold in the drying station.

According to a second embodiment, it may be provided that between the capacitor plate and the ground plate, the mold is directly received, wherein the mold is formed of an electrically insulating material, so that the capacitor plate and ground plate form a capacitor.

In this arrangement, the capacitor plate (first capacitor plate) and the ground plate (second capacitor plate) form a single capacitor.

The mold can be made entirely of plastic or other dielectric material and is placed between the two capacitor plates of the drying station.

According to a third embodiment, it may be provided that the capacitor plate in the mold receiving area comprises a first dielectric layer, and in the mold receiving area, a mold is arranged consisting of two mold halves, wherein the first mold half is formed of metal and the second mold half is formed of a dielectric material, so that the capacitor plate forms a first capacitor with the first mold half of the mold, and the first mold half forms a second capacitor with the ground plate.

According to a fourth embodiment, it may be provided that a mold comprising two mold halves is arranged in the mold receiving area, wherein the first mold half is formed of a dielectric material and the second mold half is formed of metal, so that the capacitor plate forms a capacitor with the second mold half of the mold.

With these four embodiments, it is possible to run multiple molds in the circuit. This allows the molds to be temporarily stored, regardless of the frequency of the pulper and the drying station in order to allow water to drip and/or cool down after RF heating.

This allows the system to be efficiently utilized and at the same time it is possible that, after the mold halves have been pressed together, they are given sufficient time to allow the water to escape, with sufficient time to cool down after heating. With this process, drying of the molded fiber article can be carried out in one mold by means of pressing and heating with RE.

Simultaneously with the application of electromagnetic waves, the molded fiber article can be compressed in the mold. A binder can be added to the molded fiber article. The binder can be added to the fibrous material suspension or sprayed onto the formed but not yet dried molded fiber article. The molded fiber article can also be produced completely without binding agents.

The process according to the first aspect of the present invention can be combined in a particularly advantageous manner with the process according to the second aspect of the present invention and/or with the process according to the third aspect of the present invention. Such a process then exhibits the advantages shown above with reference to the three aspects.

According to another aspect of the present invention, an apparatus for producing a molded fiber article is provided. This device comprises

- a pulper for dissolving fibrous materials in water to form a fibrous material suspension,
- a mold with two mold halves for dehumidifying the fibrous material suspension by pressing it into a molded fiber article,
- a drying station for drying the molded fiber article by supplying heat in the mold and
- a demolding station for demolding the molded fiber article from the mold.

This apparatus is characterized in that the drying station comprises a wave generator for electromagnetic waves and a control device designed to dry the molded fiber article by means of electromagnetic waves to a moisture content of not more than 10% by weight, or not more than 7.5% by weight, or not more than 5% by weight.

The mold can have a temperature sensor and/or a moisture sensor, whereby the control device for controlling the wave generator can be designed in such a way that in accordance with the measured temperature and/or the measured humidity energy is supplied to the mold by means of the electromagnetic waves. In such an apparatus for producing molded fiber articles, molded fiber articles of different shapes and sizes are generally produced during production. Accordingly, different molds are used. Depending on the size of the molded fiber article, the parameters must be set to achieve the predetermined moisture content change. These parameters include, for example, the duration with which the electromagnetic waves have to be introduced into the molded fiber article or the amount of energy required to dry the molded fiber article.

The control device is provided to control these parameters. The control device is connected to the shaft generator and the temperature sensor and/or the humidity sensor. Based on the values determined by the temperature sensor and/or the humidity sensor, the control device controls the above-mentioned parameters for drying the molded fiber article. The temperature sensor and/or the humidity sensor are preferably permanently integrated in the mold so that they are automatically coupled to the control device and can be read out when the mold is placed in the drying station.

The temperature sensor is preferably a light guide sensor.

For example, the humidity sensor can be an electrode pair sensor that measures moisture based on electrical resistance.

It is also possible that the control device carries out the drying for a predetermined time. The duration is determined empirically for each mold and the respective production process. This can also be used to achieve the desired drying quality in the mold. However, the duration of exposure to electromagnetic waves must be determined separately for each tool.

A transport device can be provided to convey the mold from the pulper to the drying station and to the demolding station.

The advantages of the apparatus according to the invention correspond to the advantages of the process according to the invention, the apparatus comprising the corresponding technical features for carrying out the above-described process steps.

Preferably, between the pulper and the drying station, a dripping device may be provided for the simultaneous dripping of one or more molded fiber articles, which is formed either by an area of the transport device or by a separate buffer area decoupled from the transport device.

In addition, a cooling station may be provided for cooling the molded fiber article in the mold.

The mold halves are preferably detachably fastened to the pulper, where they can be opened and closed automatically.

At least one of the mold halves may have through-holes for water to escape, and/or be made of a porous material.

The mold can be made of plastic or a resin, or it can also be made of a metal.

The mold is preferably formed of a material that is substantially transparent for the applied electromagnetic waves, such as high-molecular weight polyethylene (PE), polyetheretherketone (PEEK) or another non-polar plastic material.

The drying station can comprise two capacitor plates between which the mold is arranged and by means of which an electromagnetic field is applied in a mold interior space.

However, the electromagnetic waves can also be generated by means of a microwave generator or magnetron located outside of the mold.

Within the drying station, there is preferably a shielded area in which electromagnetic waves can only irradiate the mold and the molded fiber article. This primarily protects people standing outside.

The drying station may comprise one or more generators for generating and applying electromagnetic radiation disposed within the drying station to heat and thereby dry the molded fiber article located on the transport equipment.

The electromagnetic waves can be generated in the drying station with a drying station located outside the mold. This means that the mold does not have to be fixed or connected inside the drying station. It is sufficient to move the mold into the drying station and align the drying station to the mold. This minimizes the drying time and improves the overall production process.

At least one of the mold halves may have an electrically conductive surface to which a signal can be applied to generate an electromagnetic field in a mold interior space of the mold.

The mold halves are designed in such a way that at least one of the mold halves can represent a capacitor plate. An RF signal can be applied to this mold half by means of a waveguide. In this case, a dielectric layer can be placed between the mold half and the molded fiber article to prevent uncontrolled current flow to the molded fiber article. The opposite mold half can be brought into contact with a capacitor plate that is connected to ground. Here, too, a dielectric layer can be placed between the mold half and the molded fiber article.

If the second half of the mold is also electrically conductive, it represents the second capacitor plate, which is connected to ground.

The drying station may be configured to apply a signal to an electrically conductive surface of the mold to generate an electromagnetic field in a mold interior space of the mold.

In an apparatus for drying a molded fiber article according to an advantageous aspect of the present invention, the drying station may comprise a wave generator for generating electromagnetic waves, a waveguide and a capacitor plate with a mold receiving area, wherein the electromagnetic waves can be introduced from the wave generator into the capacitor plate via the waveguide.

According to a first embodiment, this apparatus may be characterized in that the capacitor plate has a first dielectric layer in the mold receiving area, and a mold made of an electrically conductive material (metal) is arranged in the mold receiving area, so that the capacitor plate forms a first capacitor with a first mold half of the mold, and wherein a second dielectric layer is provided in a contact area between the first mold half and a second mold half, so that the first mold half and the second mold half form a second capacitor.

According to a second embodiment, this apparatus may be characterized in that between the capacitor plate and the ground plate, the mold is directly received, wherein the mold is formed of a dielectric material, so that the capacitor plate and the ground plate form a capacitor.

According to a third embodiment, it may be provided that the capacitor plate in the mold receiving area comprises a first dielectric layer, and in the mold receiving area, a mold is arranged consisting of two mold halves, wherein the first mold half is formed of an electrically conductive material, such as metal, and the second mold half is formed of a dielectric material, so that the capacitor plate forms a first capacitor with the first mold half of the mold, and the first mold half forms a second capacitor with the ground plate.

According to a fourth embodiment, it may be provided that a mold comprising two mold halves is arranged in the mold receiving area, wherein the first mold half is formed of a dielectric material and the second mold half is formed of metal, so that the capacitor plate forms a capacitor with the second mold half of the mold. In an apparatus for using metal molds, it is preferably provided that the transfer plate has a dielectric layer in a mold receiving area.

In an apparatus for using molds made of electrically insulating material, such as plastic, it is preferably provided that no dielectric layer is provided on the capacitor plate connected to the waveguide.

In an apparatus for using molds made of electrically conductive and non-electrically conductive materials, it is preferably provided that the molds made of electrically conductive material each have a dielectric layer in a mold receiving area in a contact area with the transfer plate. Otherwise, the apparatus corresponds to the design for molds made of electrically conductive material.

Preferably, the apparatus for producing a molded fiber article is designed in such a way that one or more of the processes described above or process steps can be carried out with it.

Further tasks, features and advantages of the present invention are apparent from the description of the exemplary embodiment, which is illustrated in the accompanying drawing. This shows in:

FIG. 1 a schematic representation of an apparatus according to the invention.

In the following, an apparatus 1 according to the invention for producing a molded fiber article 2 is described in more detail based on an embodiment example (FIG. 1).

The apparatus 1 comprises a pulper 3, a drying station 4, a demolding station 5 and a transport device 6.

The transport device 6 comprises an upper and a lower conveyor belt device 7, 8 and a first and a second lifting device 9, 10 and is designed to transport a mold 11 in the apparatus 1 in a circuit. In this way, the transport device 6 enables one or more molds 11 to be transported in a circuit along a transport direction 12.

The linear conveyor belt devices 7, 8 are coupled to the lifting devices 9, 10 at their respective ends in such a way that the mold 11 is transported from one of the conveyor belt devices 7, 8 to the corresponding lifting devices 9, 10 and vice versa.

The conveyor belt devices 7, 8 can comprise one or more transport sections each with a conveyor belt, which are each guided around two deflection rollers and are driven independently of each other. The individual transport sections can comprise different lengths and move at different speeds. Thus, the dwell time of the individual molds 11 on the respective transport sections can be adjusted. For example, a transport section can serve as a buffer by being slowly driven and transporting many molds 11, which are arranged at a small distance on the transport section.

With the upper conveyor belt device 7, the mold 11 is moved from a starting position 13, which designates a position on the upper conveyor belt device 7 downstream of the first lifting device 9 and upstream of the pulper 3, to the individual workstations.

The lower conveyor belt device 8 runs in the opposite direction to the upper conveyor belt device 7 to transport the mold 11 from a second lifting device 10 in reverse direction 14 to the first lifting device 9.

The lifting devices 9, 10 each comprise a single movable platform 15, 16, which is moved up and down. However, the lifting devices 9, 10 can also be designed as paternoster lifts, each with several rotating platforms.

The movable platforms 15, 16 are designed as passive roller conveyors, so that the molds 11 can be easily picked up and discharged again.

The first lifting device 9 is coupled to the lower conveyor belt device 8 and to the upper conveyor belt device 7 and is arranged at one end of each of them to lift the mold 11 for starting the production process of a molded fiber article 2 from the lower conveyor belt device 8 to the upper conveyor belt device 7.

The second lifting device 10 is coupled to the upper conveyor belt device 7 and to the lower conveyor belt device 8 and is arranged at one end of each of them to lower the mold 11 after completion of the production process of a molded fiber article 2 from the upper conveyor belt device 7 to the lower conveyor belt device 8.

A slide 17, 18 is arranged on each of the conveyor belt device 7, 8 at their front end in the conveying direction or in the transport direction 12 and is designed as a passive roller conveyor so that the molds 11 can slide automatically from the conveyor belt devices 7, 8 onto the corresponding movable platforms 15, 16 of the lifting devices 9, 10.

A first slide 19 is arranged on the first lifting device 9 at the level of the upper conveyor belt device 7 to push the mold 11 from the platform 15 of the first lifting device 9 onto the upper conveyor belt device 7 and to the starting position 13 in front of the pulper 3.

A second slide 20 is arranged on the second lifting device 10 at the level of the lower conveyor belt device 8 to push the mold 11 from the platform 16 of the second lifting device 10 onto the lower conveyor belt device 8.

The mold 11 is formed of a lower mold half 21 and an upper mold half 22. In addition, the mold 11 is made of a of a material that is transparent to electromagnetic waves so that electromagnetic waves can be transmitted to the molded fiber article 2 with a low loss. The material is, for example, high molecular weight polyethylene (PE), polyetheretherketone (PEEK) or another non-polar plastic. The wall thickness of the mold halves 21, 22 is as thin as possible, so that the electromagnetic waves are only absorbed to a small extent.

The mold halves 21, 22 each comprise an outer and inner surface, the inner surfaces delimiting a mold interior space when the mold 11 is closed, the mold interior space being complementary to the respective shape of the molded fiber article 2 to be produced.

The lower mold half 21 is formed of a grid with a plurality of through holes or a porous material, so that water can escape downward.

The mold halves 21, 22 are held together in the closed state by means of frictional or positive locking. The mold halves 21, 22 can additionally and/or alternatively be frictionally and/or positively connected to one another by a locking means such as, for example, a locking mechanism or a latching device.

In the present embodiment, no locking means is provided because the mold halves 21, 22 are held together by adhesion after molding.

The mold halves 21, 22 have fitting elements at contacting interfaces. These fitting elements are wedges or conical elements and corresponding recesses, with one of the two mold halves 21, 22 providing the wedges and the other mold half 22, 21 providing the appropriate recesses. When the upper mold half 22 is placed with a small offset on the lower mold half 21, the wedges ensure that the mold halves 21, 22 assume the desired position relative to one another. In this case, the wedges of the one mold half 21, 22 slide into the recesses provided for this purpose in the other mold half 22, 21.

Pins and corresponding drill holes are provided as further fitting elements, one of the mold halves 21, 22 providing the pins and the other mold half 22, 21 providing the matching drill holes. When the mold halves 21, 22 are placed on top of each other, the pins engage in the drill holes provided for this purpose and consequently prevent horizontal displacement of the mold halves 21, 22 relative to one another.

The pins are designed so long that they only meet the corresponding drill holes after the wedges have slid into the recesses provided for this purpose and have ensured the correct alignment of the mold halves 21, 22 with respect to one another. The mold halves 21, 22 have at least one integrated hollow rail on the outside for a slide closure, the hollow rail of the lower mold half 21 being formed parallel to the hollow rail of the upper mold half 22. The hollow rails are designed to be as flat as possible to match the wall thickness of the mold halves 21, 22. The hollow rails are designed to be open on one side and are provided for horizontal displacement of the mold halves 21, 22 into a corresponding counter profile. The hollow rails can be designed, for example, as T-grooves or as dovetail grooves.

The pulper 3, the drying station 4 and the demolding station 5 each comprise an apparatus which comprises at least one corresponding projecting profile rail as a counterpart to the hollow rails of the mold halves 21, 22. The profile rails are open on one side, preferably with a latching means. The open side of the profile rails points in the direction of the upper conveyor belt device 7, so that the mold halves 21, 22 of the upper conveyor belt device 7 can be pushed onto the profile rails in such a way that the hollow rails of the mold halves 21, 22 engage in the profile rails. In this way, the mold halves 21, 22 can be coupled to the respective workstation. The counter profile can be designed, for example, as a T-profile or as a fitting connector.

The mold halves 21, 22 have beveled corners that can serve as guide surfaces when pushing the mold halves 21, 22. The workstations each comprise an apparatus, which comprises corresponding counter-guide surfaces for the guide surfaces of the mold halves 21, 22. The counter-guide surfaces run from the upper conveyor belt device 7 in a conically tapering manner in the direction of the workstation. They are designed in such a way that they engage with the guide surfaces of the mold halves 21, 22 as soon as the mold halves 21, 22 leave the upper conveyor belt device 7 during pushing in the direction of the workstation. The counter-guide surfaces run towards the corresponding working position at the workstations, whereby they ensure an exact positioning of the mold halves 21, 22 at the working positions.

A first transport section of the upper conveyor belt device 7 extends in the transport direction 12 from the first lifting device 9 to a height in front of the pulper 3. Subsequently, and at a minimum distance from the first transport section, a second transport section follows, whereby an automatic transfer of a mold 11 can take place. The second transport section runs parallel to the pulper 3 in such a way that it can provide the pulper 3 with a mold 11 and pick it up again from there. The second transport section comprises a conveyor belt, which is grid-shaped with a plurality of openings so that water can drip into a basin located below.

The pulper 3 comprises an upwardly open container 25 and is arranged adjacent to the transport device 6 in such a way that the upper edge of the container 25 is arranged approximately at the level of the upper conveyor belt device 7.

A shredder device (not shown) can be provided, which is designed to break up or shred a fibrous material so that the fibrous material is present in thin fiber strands. In the case of a starting material that is already present in thin fiber strands, the shredder device can also be omitted, and the fibrous material can be fed directly to the pulper 3.

The pulper 3 has an agitator (not shown) with a stirrer driven by a motor to mix the fibrous material with water to form a fibrous material suspension. This fibrous material suspension is a viscous pulp that can be conveyed from the pulper 3 into the container 23 by means of a pump (not shown).

The pulper 3 comprises a lower lifting device 24 and an upper lifting device 25, which can be moved vertically. The lower lifting device 24 is integrated in the container 23 of the pulper 3. In the present embodiment, the lifting devices 24, 25 are each a piston/cylinder unit.

The lifting devices 24, 25 comprise at least one protruding profile rail, preferably with a latching means to receive the corresponding mold half 21, 22, comprising at least one integrated hollow rail.

The lower lifting device 24 comprises counter-guide surfaces for the guide surfaces of the lower mold half 21. The counter-guide surfaces run from the upper conveyor belt device 7 in a conically tapering manner in the direction of the lower lifting device 24. They are designed in such a way that they engage with the guide surfaces of the mold half 21 as soon as the mold half 21 leaves the upper conveyor belt device 7 while being pushed in the direction of the lower lifting device 24. The counter-guide surfaces run towards the corresponding working position on the lower lifting device 24, ensuring an exact positioning of the mold 11 at the working position.

A third slide 27 is arranged opposite the pulper 3 on the other side of the upper conveyor belt device 7 to push the mold 11 onto the lower lifting device 24 of the pulper 3, wherein the upper mold half 22 of the mold 11 is simultaneously received by the upper lifting device 25.

A fourth slide 28 is arranged opposite the first slide 27 on the other side of the pulper 3 to push the mold 11 from the lower lifting device 24 of the pulper 3 back onto the upper conveyor belt device 7 after completion of the forming process.

The second transport section of the upper conveyor belt device 7 extends in the transport direction 12 from the position parallel to the pulper 3 up to a height just in front of the drying station 4.

In the second transport section, a dripping device (not shown) is provided between the pulper 3 and the drying station 4 for simultaneously dripping of one or more molded fiber articles 2. The dripping device is formed either by an area of the transport device 12, in particular the second transport section, or by a separate buffer area (not shown) decoupled from the transport device 12.

The second transport section is followed by a third transport section, whereby an automatic transfer of a mold 11 can take place. The third transport section runs parallel to the drying station 4 in such a way that it can provide the drying station 4 with the mold 11 and pick it up again from there.

The drying station 4 is arranged adjacent to the transport device 6 in such a way that a dead plate 31 is arranged approximately at the level of the upper conveyor belt device 7, on which the mold 11 rests during the drying process.

The drying station 4 comprises a drying device comprising a horizontally arranged capacitor plate 29 and a horizontally arranged ground plate 30. The capacitor plate 29 is connected to an RF generator 34, which can be used to apply an RF signal to the capacitor plate 29 by means of a waveguide 35. The ground plate 30 is connected to ground via a ground cable 36. The capacitor plates 29, 30 are designed to generate an electromagnetic field in the intermediate region of the two plates 29, 30, with which electromagnetic waves can be applied to the molded fiber article 2 in the mold 11 to dry the molded fiber article 2.

In this embodiment, it is possible to make the ground plate 30 vertically movable since only one movable ground cable 36 is guided to the plate 30.

The capacitor plate 29 is arranged in a stationary position, which means that the waveguide 35 can also be arranged in a stationary position. A reverse arrangement with a movable waveguide is also possible, but technically more difficult to implement.

The capacitor plate 29 comprises the dead plate 31, which rests on the capacitor plate 29 and is firmly connected to it. The ground plate 30 comprises plate 32, which is firmly connected to it. The plates 31, 32 are made of a non-electrically conductive material.

The ground plate 30 is connected to the first lifting device 33. In the present embodiment, the first lifting device 33 is a piston/cylinder unit.

The plates 31, 32 comprise at least one protruding profile rail, preferably with a latching means to receive the corresponding mold half 21, 22, comprising at least one integrated hollow rail. The profile rails are each made of a non-electrically conductive material. The profile rails are not only used for fixing fix the mold 11 in the drying station, but also to fill the cavities of the hollow rails on the mold halves 21, 22 to ensure a sealed surface between the plates 31, 32 of the capacitor plates 29, 30 and the corresponding mold halves 21, 22.

The dead plate 31 of the condenser plate 29 comprises counter-guide surfaces for the guide surfaces of the lower mold half 21. The counter-guide surfaces run from the upper conveyor belt device 7 in a conically tapering manner in the direction of the dead plate 31. They are designed in such a way that they engage with the guide surfaces of the mold half 21 as soon as the mold half 21 leaves the upper conveyor belt device 7 while being pushed in the direction of the dead plate 31. The counter-guide surfaces run towards the corresponding working position on the dead plate 31, ensuring an exact positioning of the 11 at the working position.

The radio frequency signal is preferably generated in a frequency range of at least 5 or 10 or 15 or 20 or 25 MHz up to not more than 50 or 45 or 40 or 35 or 30 MHz. The actual frequency used depends on which frequency is approved for industrial use. For example, In Germany it is allowed to use the frequency of 27.12 MHz. The amplitude can range from a few 100 volts to a few kV.

In another embodiment, the drying station 4 comprises the wave generator 34 for generating electromagnetic waves, the waveguide 35, the capacitor plate 29 and the ground plate 30.

The capacitor plate 29 and the ground plate 30 are made of metal.

By means of the wave generator 34, the electromagnetic waves can be introduced into the capacitor plate 29 via the waveguide 35.

The ground plate 30 is connected to ground via a ground cable 36.

The capacitor plate 29 and the ground plate 30 are arranged in such a way that they form a mold receiving area between themselves. The mold receiving area is designed to receive a mold 11 from an electrically conductive material (metal).

In this arrangement, the capacitor plate 29 and the first mold half 21 of the mold 11 form a first capacitor and the first mold half and the second mold half 22 of the mold 11 a second capacitor.

A first dielectric layer 31 is arranged between the capacitor plate 29 and the first mold half 21 of the mold 11. The first dielectric layer 31 is preferably fixed to the capacitor plate 29, but can also be arranged on a surface of the first mold half 21

A second dielectric layer is arranged between the first mold half 21 of the mold 11 and the second mold half 22 of the mold 11. The second dielectric layer is arranged equally in both mold halves 21, 22 or is arranged in only one of the two mold halves 21, 22.

Due to the dielectric layer between the capacitor plate 29 and the first mold half 21, one has a defined plate capacitor that reliably transmits the electromagnetic waves to the molded fiber article 2 and does not lead to uncontrolled welding or electrical flashovers between the metallic components of the assembly.

It is also possible to connect the waveguide 35 directly to the first mold half 21 of the mold 11, as well as to connect a ground cable 36 directly to the second mold half 22 of the mold 11, however, this is technically more difficult to implement.

The amplitude can also be gradually increased from a small initial value to a larger final value. The increase is preferably linear along a predetermined ramp. The ascending slope and/or the final value of the ramp can be varied depending on the water content in the molded fiber article 2.

In the embodiment example explained above, electromagnetic waves in the form of RF radiation are used. Instead of RF radiation, microwave radiation could also be applied. Microwave radiation can be generated very easily and cost-effectively by means of a magnetron. When microwave radiation is used, there is no use for a capacitor. Such an apparatus operating with microwave radiation is simpler and more cost-effective than an apparatus operating with RF radiation, however, has significant disadvantages due to the short wavelength and the inhomogeneous radiation distribution. The short wavelength of microwave radiation results in significant local differences in heat input. This can lead to undesirable non-uniform heating, especially in the case of larger molded fiber articles.

When microwave radiation is used instead of RF radiation, in the embodiment explained above, the plate capacitor can be replaced by a microwave tunnel to which microwaves are supplied by means of one or more magnetrons. A fifth slide 37 is arranged opposite the drying station 4 on the other side of the upper conveyor belt device 7 to push the mold 11 onto the dead plate 31 of the capacitor plate 29, wherein the upper mold half 22 of the mold 11 is simultaneously received by plate 32 of the upper capacitor plate 30.

A sixth slide 38 is arranged opposite the slide 37 on the other side of the drying station 4, to push the mold 11 back from the dead plate 31 of the lower capacitor plate 29 onto the upper conveyor belt device 7 after completion of the drying process.

The third transport section of the upper conveyor belt device 7 extends in the transport direction 12 from the position parallel to the drying station 4 to the first slide 17 after the demolding station 5. The third transport section runs parallel to the demolding station 5 in such a way that it can provide the mold 11 to the demolding station 5 and can pick it up again from there. In addition, a cooling station (not shown), which is arranged upstream of the demolding station 5, may be provided along the third transport section to rapidly cool the mold 11 and the molded fiber article 2. By the use of electromagnetic waves, the mold 11 and the molded fiber article 2 were heated up to a high degree.

A cooling station is an optional workstation. If active cooling is provided, the cooling station makes the entire process more efficient.

The cooling station comprises a cooling device, which is at least one air blower to quickly cool the mold 11 and the molded fiber article 2.

The cooling station is preferably a long tunnel along the third transport section of the upper conveyor belt device 7, starting shortly after the drying station 4 and ends shortly before the demolding station 5 and comprising several air blowers to gradually cool the mold 11 and the molded fiber article 2 during passage through the tunnel.

After the cooling station, the demolding station 5 follows to open the mold 11 and remove the molded fiber article 2.

The demolding station 5 is arranged adjacent to the transport device 6 in such a way that a demolding surface 39 is arranged approximately at the level of the upper conveyor belt device 7, on which the mold 11 rests during the demolding process.

The demolding station 5 comprises a second lifting device 40, which is vertically movable and in the present embodiment is a piston/cylinder unit.

The demolding station 5 has a gripping device 42, which is connected to a third lifting device 41. In the present embodiment, the third lifting device 41 is designed as a piston/cylinder unit. The third lifting device 41 and the gripping device 42 can thus be moved in the vertical direction.

The gripping device 42 comprises a gripper 43, which is designed to grip the finished molded fiber article 2 from the opened mold 11.

The second lifting device 40 and the gripping device 42 are each attached to a rail 45 by means of a carriage 44, 50 and can thus be moved horizontally.

The demolding surface 39, and the second lifting device 40 comprise at least one protruding profile rail, preferably with a latching means to receive the corresponding mold half 21, 22, comprising at least one integrated hollow rail.

The demolding surface 39 comprises counter-guide surfaces for the guide surfaces of the lower mold half 21. The counter-guide surfaces run from the upper conveyor belt device 7 in a conically tapering manner in the direction of the demolding surface 39. They are designed in such a way that they engage with the guide surfaces of the lower mold half 21 as soon as the mold half 21 leaves the upper conveyor belt device 7 while being pushed in the direction of the demolding surface 39. The counter-guide surfaces run towards the corresponding working position on the demolding surface 39, ensuring an exact positioning of the mold 11 at the working position.

A seventh slide 46 is arranged opposite the demolding station 5 on the other side of the upper conveyor belt device 7 to push the mold 11 onto the demolding surface 39 of the demolding station 5, wherein the upper mold half 22 of the mold 11 is simultaneously received by the second lifting device 40.

An eighth slide 47 is arranged opposite the slide 46 on the other side of the demolding station 5, to push the mold 11 back from the demolding surface 39 of the demolding station 5 onto the upper conveyor belt device 7 after completion of the demolding process.

Preferably, a cleaning station 48 is provided along the lower conveyor belt device 8 and is configured to clean the mold 11 prior to reuse.

The cleaning station 48 comprises a cleaning device 49, which can be a water shower that rinses the mold 11.

A process of the apparatus 1 described above for producing a molded fiber article 2 is explained below. In the following, the process is described using the throughput of a mold. However, it is provided that the process can be used to process several molds in succession and/or in parallel at the workstations.

The mold 11 is pushed by means of the first slide 19 from the movable platform 15 of the first lifting device 9 to the starting position 13, which is on the upper conveyor belt device 7 in front of the pulper 3.

The upper conveyor belt device 7 transports the mold 11 up to the height of the pulper 3.

The mold 11 is pushed onto the lower lifting device 24 of the pulper 3 by means of the third slide 27. The upper mold half 22 of the mold 11 is simultaneously picked up by the upper lifting device 25.

The integrated profile rails of the lower mold half 21 or the upper mold half 22 engage in the corresponding counter profiles, preferably with a latching means, of the lower lifting device 24 or the upper lifting device 25 and fix the mold halves 21, 22.

The lower lifting device 24 lowers the lower mold half 21 into the container 23 so that the lower mold half 21 is below the level of the fibrous material suspension 26, i.e., the lower mold half 21 is then completely immersed in the fibrous material suspension and fills with fibrous material suspension. In FIG. 1, the lower lifting device 24 is configured in such a way that the lifting device 24 extends through a bottom of the container 23. In practice, however, it is often easier to arrange the lower lifting device 24 completely within the container 23, as there is then no through-hole to seal.

The upper and lower mold half 22, 21 are moved together in such a way that they delimit between them a mold interior space, which corresponds approximately to the molded fiber article 2 to be produced.

The two mold halves 21, 22 can be moved together in pulper 3 below the level of the fibrous material suspension, so that the entire mold interior space is filled with the fibrous material suspension. Then the mold 11 is raised via the level to approximately the height of the upper conveyor belt device 7.

After lifting the forming tool 11 with the fibrous material suspension above the level of the container 23 of the pulper 3, the moisture content of the molded fiber article 2 quickly reduces to a value of not more than 80% by weight or not more than 70% by weight or not more than 60% by weight.

The two lifting devices 24, 25 press the two mold halves 21, 22 together in such a way that water is pressed out of the fibrous material suspension located in the mold interior space of the mold 11 and the fibrous material suspension is formed into the molded fiber article 2.

After forming the molded fiber article 2, the mold 11 is pushed back from the lower lifting device 24 of the pulper 3 onto the upper conveyor belt device 7 by means of the fourth slide 28.

When the wet fibrous material suspension is compressed during forming in the mold 11, the outlet holes of the mold 11 are plugged and joints are sealed. As a result, air con no longer enter the inside of the mold 11. As a result, the mold halves 21, 22 adhere to each other and a large force is required to separate the mold halves 21, 22. This connection can be so tight that locking is no longer required to ensure that the mold halves 21, 22 are not accidentally disconnected. In this case, it is then not necessary to use the locking or latching device on the mold 11.

The upper conveyor belt device 7 transports the mold 11 further from the pulper 3 to the dripping device. In the dripping device, the mold 11 drips off until the molded fiber article 2 has reached a predetermined moisture content and is suitable for drying by means of electromagnetic waves in the drying station 4.

Here it is possible to form several molded fiber articles 2 directly one after the other and/or to dry them directly one after the other, whereby several molds 11 with the molded fiber articles 2 contained therein can be held 2 in one step for dripping until sufficient moisture has escaped from the molds 11. As soon as a predetermined degree of dryness has been reached, a mold 11 with a molded fiber article 2 can be fed to the drying station 4.

After pressing the fibrous material suspension in the mold 11 and dripping, the molded fiber article still has a moisture content of not more than 30% by weight or not more than 25% by weight or not more than 20% by weight. From the dripping device, the conveyor belt device 7 transports the mold to the drying station 4, which has a drying device.

The mold 11 is pushed onto the deposit area 31 of the drying device by means of the fifth slide 37.

The ground plate 30 of the drying device is moved onto the upper mold half 22 of the mold 11 by means of the first lifting device 33. The lower mold half 21 of the mold 11 is in contact with the capacitor plate 29 via the deposit area 31.

The capacitor plate 29 and the ground plate 30 are configured to generate a strong alternating electromagnetic field between them by means of the RF generator 34, which is connected to the capacitor plate 29, and thus to transmit electromagnetic waves in the form of RF waves to the molded fiber article 2.

The RF waves are absorbed to a considerable extent by the water present in the molded fiber article 2. The water is heated and evaporates from the molded fiber article 2, causing it to form-dry and cure.

The use of RF waves makes it is possible to heat the molded fiber article 2 quickly from the inside out in a short time, thereby achieving the desired degree of dryness correspondingly. However, it would also be possible to heat the mold 11 directly via a heating device and thus indirectly mold-dry the molded fiber article 2. However, this is significantly less efficient than heating the molded fiber article 2 directly using electromagnetic waves.

In addition to RF waves, microwaves can also be used as electromagnetic waves. However, in contrast to microwaves, RF waves have the advantage that they heat the entire molded fiber article 2 uniformly at once due to their longer wavelength. With microwaves, the heat input is locally limited, and they are therefore more suitable for smaller molded fiber articles 2.

The mold drying of the molded fiber articles 2 by means of the electromagnetic waves reduces the moisture content of the molded fiber article 2 to a value of not more than 10% by weight or not more than 7.5% by weight or not more than 5% by weight. In another embodiment, a process for drying the molded fiber article 2 in the drying station 4 is provided, in which a mold 11 formed of an electrically conductive material (metal) and formed of a first mold half 21 and a second mold half 22, is moved into a mold receiving area between the capacitor plate 29 and the ground plate 30.

Electromagnetic waves are generated by the wave generator 34 and introduced into the capacitor plate 29 via the waveguide 35. The ground plate 30 is connected to ground via a ground cable 36.

The first mold half 21 of the mold 11 is in contact with the capacitor plate 29 via a first dielectric layer 31. The first mold half 21 and the capacitor plate 29 form a first capacitor.

The first mold half 21 of the mold 11 and the second mold half 21 form a second capacitor.

The electromagnetic waves are transmitted to the molded fiber article 2 via the capacitor plate 29 and the first mold half 21 of the mold 11 and dry the molded fiber article 2.

After the drying process, the ground plate 30 of the drying device is moved upwards away from the upper mold half 22 of the mold 11 by means of the first lifting device 33.

The mold 11 is pushed back onto the upper conveyor belt device 7 by means of the sixth slide 38 from the depositing surface 31 of the drying device.

The upper conveyor belt device 7 transports the mold 11 further from the drying station 4 to the cooling station. The cooling station is an optional workstation. If active cooling is provided, a cooling station makes the whole process more efficient.

The cooling station is arranged so that the mold 11 with the molded fiber article 2 can remain on the upper conveyor belt device 7 can remain and be cooled there.

The mold 11 with the molded fiber article 2 is cooled by one or more air blowers of the cooling station as it moves through the cooling station.

In addition to the cooling process, the mold 11 is simultaneously conveyed further to the demolding station 5. The upper conveyor belt device 7 transports the mold 11 to the level of the demolding surface 39.

The mold 11 is pushed onto the demolding surface 39 of the demolding station 5 by means of the seventh slide. The upper mold half 22 of the mold 11 is simultaneously picked up by the second lifting device 40.

The integrated profile rails of the lower mold half 21 or the upper mold half 22 engage in the corresponding counter profiles, preferably with a latching means, of the demolding surface 39 or the lifting device 40 and fix the mold halves 21, 22.

By lifting the upper mold half 22 by means of the second lifting device 40, the mold 11 is opened and the molded fiber article 2 is exposed.

The second lifting device 40 and the gripping device 42 are moved in the rail 45 by means of the carriages 44, 50 in such a way that the second lifting device 40 moves away to the side with the upper mold half 22 and the gripping device 42 stops above the molded fiber article 2 and the lower mold half 21.

By lowering the gripping device 42 by means of the third lifting device 41 and closing the gripper 43, the molded fiber article 2 can be picked up. By raising and lowering the gripping device 42 and moving the carriage 44 in the rail 45, the molded fiber article 2 can be deposited on the depositing surface 51.

Synchronously, the upper mold half 22 can be reunited with the lower mold half 40 by raising and lowering the second lifting device 21 accordingly and moving the carriage 50 in the rail 45.

After the demolding process, the mold 11 is pushed by means of the eighth slide from the demolding surface 39 of the demolding station 5 back onto the upper conveyor belt device 7.

The upper conveyor belt device 7 transports the mold 11 further from the demolding station 5 to the first slide 17.

The mold 11 is conveyed from the upper conveyor belt device 7 to the first slide 17 and from there it is automatically moved by means of the passive roller conveyor of the slide 17 to the second movable platform 16 of the second lifting device 10.

The second lifting device 10 conveys the mold 11 downwards to the level of the lower conveyor belt device 8, where the mold 11 is pushed by means of the second slide 20 from the movable platform 16 to the lower conveyor belt device 8 and simultaneously in the direction of the cleaning station 48.

The cleaning device 49, which can be a water shower, cleans the mold 11 as it passes through the cleaning station 48 on the lower conveyor belt device 8.

After completion of cleaning, the mold 11 is transported to the second slide 18 by the lower conveyor belt device 8 and conveyed from the lower conveyor belt device 8 to the second slide 18. From there, the mold 11 is automatically moved by means of the passive roller conveyor of the second slide 18 onto the movable platform 15 of the first lifting device 9.

The first lifting device 9 conveys the mold 11 upwards to the height of the upper conveyor belt device 7, where it is then ready for the next forming process.

In the embodiment explained above, the mold 11 is lowered into the container 23 and retracted there to receive the fibrous material suspension in the mold interior space. It is also possible to arrange the lower mold half 21 stationary above the container 23 and to pump the fibrous material suspension from below through the lower mold half 21 into the mold interior space limited by the mold 11 by means of a pump. Water can then escape again from the mold interior space through the lower mold half 21 and drip back into the container 23.

In order to prevent excessive dilution of the fibrous material suspension in the container 23 in the long term, it may also be advisable to drain off the water from the mold 11 so that it does not enter the container 23.

In the embodiment explained above, the capacitor plate 29 and the ground plate 30 are designed in such a way that the capacitor plate 29 is in contact with the lower mold half 21 and the ground plate is moved onto the upper mold half 22 in an interference fit. In principle, the two capacitor plates 29, 30 can also be moved laterally against the two mold halves 21, 22.

In the embodiment described above, it is primarily the cycle rate of the cooling station that determines how many molded fiber articles 2 are produced per time unit and thus the efficiency of the complete process. The cooling of the molded fiber articles 2 is the most time-consuming step of the process. The molding, the drying and the demolding of the molded fiber articles 2, on the other hand, is faster.

A circulation device can be provided at the pulper 3, which runs independently of the upper conveyor belt device 7 and is designed to receive several molds 11 after the forming of the molded fiber article 2. Further, this allows additional molded fiber articles 2 to be formed, while others are still in the drying station 4. The circulation device can be an additional conveyor belt that moves the molds 11 in a circuit. In this case, the speed of the conveyor belt can be set variably and independently of the upper conveyor belt device 7 of the transport device 6. The additional conveyor belt can be designed as a grid so that water can drip through it into a collection container. The circulating device can also be a paternoster that moves the forming tools 11 in a circle. A possible and inexpensive alternative to the circulation device is a long conveyor belt section between pulper 3 and drying station 4.

The cooling station can be provided as a circulating device that runs independently of the upper conveyor belt device 7 and is designed to receive several molds 11 after the drying of the molded fiber article 2 to cool the molded fiber articles 2 in the air. Further, this allows additional molded fiber articles 2 to be dried, while others are still in the cooling station. The circulation device can be another conveyor belt that moves the molds 11 in a circuit. In this case, the speed of the conveyor belt can be set variably and independently of the upper conveyor belt device 7 of the transport device 6. The circulation device can also be a paternoster that moves the molds 11 in a circle. A possible and inexpensive alternative to the circulation device is a long conveyor belt section between drying station and demolding station 5. The cooling station can be a tunnel comprising several air blowers that dries the molds as they pass through. As a result, the upper conveyor belt device 7 can continue to run continuously.

LIST OF REFERENCE NUMBERS

1 apparatus
2 molded fiber article
3 pulper
4 drying station
5 demolding station
6 transport equipment
7 upper conveyor belt device
8 lower conveyor belt device
9 first lifting device
10 second lifting device
11 mold
12 transport direction
13 starting position
14 reverse direction
15 first moving platform
16 second moving platform
17 first gravity chute
18 second gravity chute
19 first slide
20 second slide
21 lower mold half/first mold half
22 upper mold half/second mold half
23 containers
24 lower lifting device
25 upper lifting device
26 mirror of the pulp suspension
27 third slide
28 fourth slide
29 capacitor plate
30 ground plate
31 dead plate/first dielectric layer
32 plate
33 first lifting device
34 RF generator
35 waveguide
36 ground cable
37 fifth slide
38 sixth slide
39 demolding surface
40 second lifting device
41 third lifting device
42 gripping device
43 gripper
44 first slide
45 rail
46 seventh slide
47 eighth slide
48 cleaning station
49 cleaning device
50 second carriage
51 storage space

The invention claimed is:

1. A process for producing a molded fiber article comprising the steps dissolving of fibrous materials in water to form a fibrous material suspension in a pulper, dehumidifying of the fibrous material suspension by pressing to form a molded fiber article in a mold drying the molded fiber article by supplying heat to the mold and demolding of the molded fiber article from the mold, in which during a mold drying of the molded fiber article, the molded fiber article is subjected to electromagnetic waves to dry the molded fiber article in the mold until a moisture content of the molded fiber article of not more than 10% by weight or not more than 7.5% by weight or not more than 5% by weight is achieved, wherein the molded fiber article is dried in a drying station and then demolded from the mold in a demolding station, wherein the pulper, the drying station and the demolding station; and wherein either:

electromagnetic waves are generated in the drying station by a wave generator and are introduced via a waveguide into a capacitor plate with a mold receiving area, and wherein the capacitor plate has a first dielectric layer in the mold receiving area, and a mold made of an electrically conductive material is arranged in the mold so that the capacitor plate forms a first capacitor with one first mold half of the mold, and wherein a second dielectric layer is provided in a contact region between the first mold half and a second mold half, so that the first mold half and the second mold half form a second capacitor; or between a capacitor plate and a ground plate, the mold is directly received, wherein the mold is formed of an electrically insulating material, so that the capacitor plate and ground plate form a capacitor.

2. The process according to claim 1, wherein the molded fiber article after dehumidifying the fibrous material suspension in the mold has a moisture content of not more than 30% by weight or not more than 25% by weight or not more than 20% by weight.

3. The process according to claim 1, wherein the mold is conveyed by a transport device, from the pulper to the drying station and to the demolding station.

4. The process according to claim 1, wherein one or more molds are releasably attached to at least one of the workstations and/or to the transport device, so that, after processing in at least one of the workstations, one or more molds are coupled into or out of one of the workstations and/or the transport device accordingly, automatically.

5. The process according to claim 1, wherein one or more molds are conveyed in at least one circuit by the transport device.

6. The process according to claim 1, wherein a step of dripping the molded fiber article in the mold is provided between the step of dehumidifying and the step of drying.

7. The process according to claim 1, wherein the drying station and/or a cooling station and/or the demolding station are arranged in a transport direction along the transport device and receive at least one mold for processing in succession or simultaneously.

8. The process according to claim 1, wherein the drying station and/or a cooling station and/or the demolding station are arranged in the transport direction along the transport device, the drying station, the cooling station, and the demolding station receiving two or more molds for processing in succession and/or simultaneously.

9. The process according to claim 1, wherein the mold is placed between at least two capacitor plates of the drying station, wherein the electromagnetic waves being applied to the mold via the capacitor plates.

10. The process according to claim 1, wherein electromagnetic waves are generated in the drying station by a wave generator and are introduced via a waveguide into a capacitor plate with a mold receiving area.

11. The process according to claim 1, wherein electromagnetic waves are generated in the drying station by the wave generator and are introduced via the waveguide into the capacitor plate with the mold receiving area.

12. The process according to claim 1, wherein electromagnetic waves are generated in the drying station by the wave generator and are introduced via the waveguide into the capacitor plate with the mold receiving area, and wherein the mold is formed of a dielectric material, so that the capacitor plate and the ground plate form a capacitor.

13. The process according to claim 1, wherein simultaneously with the application of the electromagnetic waves, the molded fiber article in the mold is compressed in the drying station.

* * * * *